United States Patent [19]

Sjögren

[11] Patent Number: 4,768,696

[45] Date of Patent: Sep. 6, 1988

[54] ARRANGEMENT IN NAIL DRIVING APPARATUS

[75] Inventor: Börje Sjögren, Huddinge, Sweden

[73] Assignee: Nordisk Kartro AB, Farsta, Sweden

[21] Appl. No.: 130,387

[22] PCT Filed: Apr. 24, 1986

[86] PCT No.: PCT/SE87/00153

§ 371 Date: Dec. 1, 1987

§ 102(e) Date: Dec. 1, 1987

[87] PCT Pub. No.: WO87/06516

PCT Pub. Date: Nov. 5, 1987

[30] Foreign Application Priority Data

Apr. 24, 1986 [SE] Sweden ..... 8601900

[51] Int. Cl.[4] ..... B25C 1/04

[52] U.S. Cl. ..... 227/8; 227/116

[58] Field of Search ..... 227/8, 116, 114, 115

[56] References Cited

U.S. PATENT DOCUMENTS 2,982,595 5/1961 Rogers, Jr. ..... 227/136
3,259,292 7/1966 Maynard ..... 227/8
3,330,462 7/1967 Colechia et al. ..... 227/136
4,380,312 4/1983 Landrus ..... 227/116
4,470,531 9/1984 Anstett ..... 227/116 X

*Primary Examiner*—Paul A. Bell
*Attorney, Agent, or Firm*—Young & Thompson

[57] ABSTRACT

An arrangement for advancing a continuous strip of nails to a nail driving section (5) of an apparatus having a safety-catch device (24) and a nail strip magazine, and holding the strip in the driving section. One nail at a time is separated from the strip and then driven into a workpiece. A strip guide path (7) in the magazine (6) adjoins the driving section (5), and the strip is biased therein towards a driving location. A rotatable and sideways movable nail positioning element (35) positions the foremost nail in the driving position. The movable safety-catch device (24) is biased to a forward safety position and has a surface (31) near said element (35). A movable latching element (38) is arranged between said surface (31) and positioning element. As the device (24) is retracted, said surface (31) is urged against the latching element (38) thereby moving the positioning element (35) into position-fixing engagement with the strip, immediately behind the foremost nail in the driving position.

7 Claims, 1 Drawing Sheet

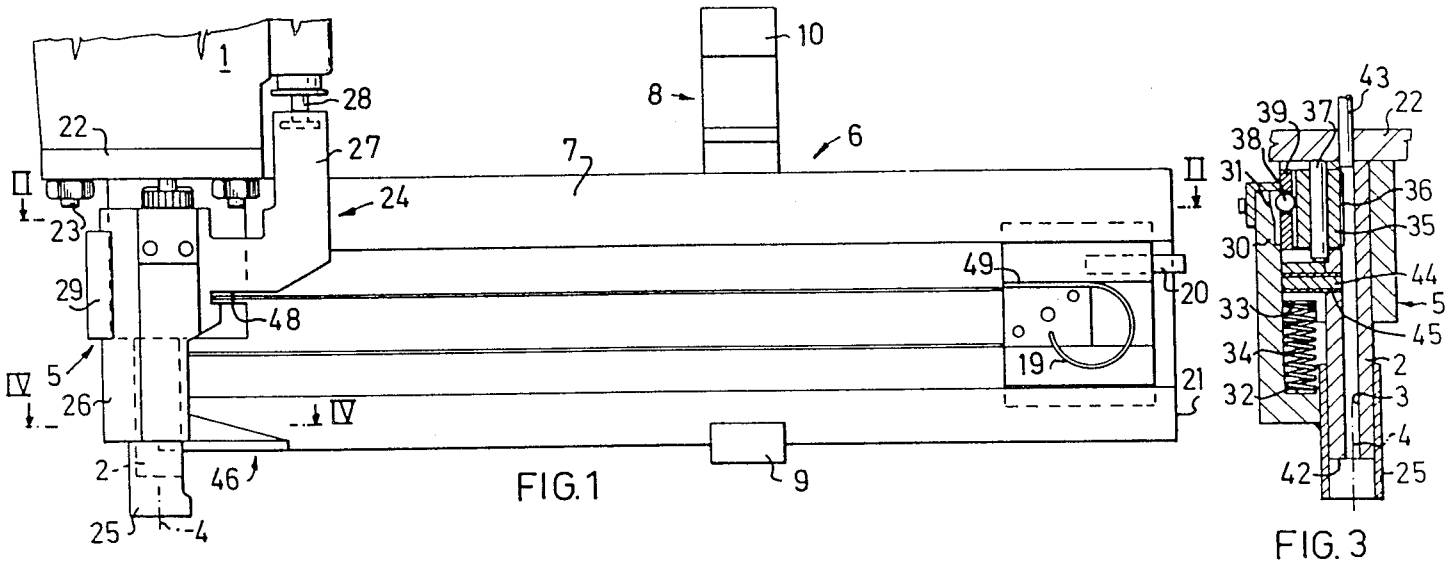
FIG. 1
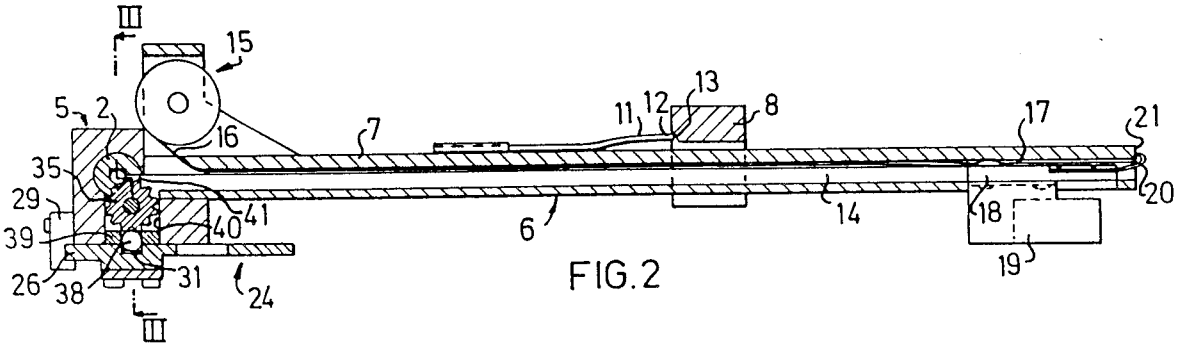
FIG. 2
FIG. 3
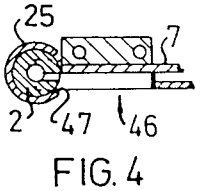
FIG. 4

ARRANGEMENT IN NAIL DRIVING APPARATUS

The present invention relates to an arrangement for advancing a strip of nails or equivalent fasteners into, and holding the nail strip in the nail-driving section of a nail driving tool, for example a nail gun, provided with a safety-catch device and a nail strip magazine, and which arrangement includes means for separating the nails or like fasteners from the strip one at a time, and for driving the nails thus separated into a workpiece to be nailed. It will be understood that by nail strip is meant here and in the following appendages of nails or like fasteners mutually held in side-by-side spaced relationship, or strips of nails and like fasteners formed integrally with one another in contiguous side-by-side relationship to form a continuous integrated single piece structure. It will also be understood that the nails or like fasteners may be made of any suitable material, preferably sheet metal.

The use within manufacturing industries of automatic nailing machines or like apparatus, of varying degrees of automation, for the mechanized nailing of goods has increased in recent years. In machines/apparatus of the nature referred to the nails are normally taken from a magazine, or may in themselves form a magazine, in a manner which enables nailing to be effected continuously, with short intervals between consecutive nail driving sequences, without risk of interruption in operation.

When the nails fed to the machine/apparatus are in the form of "banded" appendages, they are normally held in or on a nail carrying strip in uniform spaced relationship therealong, or may have the form of a coherent strip of contiguous, mutually connected nails formed integrally with or incorporated in a metal band or sheet-metal strip. The machine (apparatus) strips the nails from the nail strip one at a time and drives the separate nails into the workpiece.

It has been found in practice that nails formed integrally to provide a sheet-metal strip (hereinafter referred to as "integrated nails") are often to be preferred to nails which are fastened in or attached to a carrier tape or band, since such "nail-loaded carrier bands" are, among other things, more expensive to produce and require the carrier band to be loaded with nails. In addition, the carrier-band residues remaining when all nails in the band have been used create waste.

An example of banded integrated nails is found described and illustrated in Swedish Patent Application No. 8504557-3.

The present invention thus relates to an arrangement of the aforesaid kind, used in nail driving apparatus loaded with nails in strip form.

When manufacturing or producing strips of mutually integrated nails as hereinbefore defined, with the aid of mechanical means, it is endeavoured to produce nail strips in which all individual nails, or nail forms, present in the strip have mutually identical cross-sectional shapes and are located at a constant, uniform distance from mutually adjacent nails, so that the nail pitch is constant along the whole length of the strip.

In practice, however, it is impossible to ensure absolute constant cross-sectional shape and constant nail pitch at reasonable costs, and consequently the cross-sectional shape of such nails, or nail forms, and the nail pitch, i.e. the distance between two mutually adjacent nails, will vary necessarily within certain given tolerances along the length of the strip, thereby requiring subsequent adjustments to be made to nail positions during a nail firing or driving sequence. Manufacturing tolerances permitted in the driving track and barrel bore incorporated in the nail driving section, or breech, of the apparatus also make it necessary to finely adjust the position of a nail positioned in the nail driving location, or breech position, prior to "triggering" the apparatus.

Consequently, the primary object of the invention is to provide in such apparatus an arrangement which will ensure that a nail strip is advanced through a distance equal to the nail pitch, i.e. the distance between two mutually adjacent nails, and also ensure that the nail strip thus advanced is held in a manner such that the nail located foremost in the strip occupies precisely the correct position for separation of the nail from the nail strip and for driving of the nail into the workpiece, i.e. is located precisely in register with the centre of the barrel of the apparatus, despite the variations inherent in the nail strip and in the nail bore as a result of manufacturing tolerances. This precise alignment or positioning of a nail which is next to be separated from the strip and driven into a workpiece has been found necessary in order to be absolutely sure that stoppages will not occur as a result of the nail being separated wrongly from the nail strip, or being damaged, buckled or jammed in the barrel bore due to being misaligned and out of register with the imaginary propulsion line along which the nail driving force is imparted to the nail in the bore, such misalignment of the nail resulting in stoppages in the automatic nail driving operation.

In accordance with the invention this object can be achieved with an arrangement of the aforesaid kind in which:

the magazine incorporates a strip guide path which connects with the nail driving section of the apparatus and accommodates the nail strip, and in which the strip is advanced, either continuously or intermittently, towards a nail driving location, or breech location, in said section with the aid of strip feed means provided in the strip guide path and acting on said strip;

that the nail driving section has journalled for rotation and lateral movement therein a rotatable nail positioning element which can be brought into engagement with the nail strip in a manner to bring the foremost nail in the nail strip into a desired exact nail separating and nail driving position;

that the safety device is movable in relation to the nail driving section and has provided thereon a latching surface which is located in the region of the nail positioning element, and that biassing means, e.g. spring means, is provided for holding the safety device in a forward safety position;

that a latching means, e.g. a spherical body, which is journalled for movement between the latching surface and the nail positioning element and which, upon withdrawal of the safety device in readiness for a nail driving sequence is activated by the latching surface in a manner to move the nail positioning element to position-fixing latching engagement with the nail strip at a location immediately behind said foremost nail positioned in the nail driving location; and that the nail driving location is so constructed as to prevent a separate, lone nail from twisting therein.

Nail driving apparatus of the kind intended here comprise, for example, a pneumatic nail gun having a barrel in which there is provided a bore into which nails are loaded singly through an aperture located in the side of the barrel, these nails being taken from a nail strip placed in a nail strip magazine adjoining the barrel in the region of the side aperture and arranged for movement along said magazine. When the foremost nail in the nail strip is located in its correct position in the barrel, i.e. the nail driving location, it is separated from the strip and, in conjunction therewith, driven in the workpiece to be nailed by means of a percussion tool in the form of a pneumatic plunger or percussion rod arranged for reciprocatory movement in the bore of the barrel, the percussion means being driven by or comprising part of a pneumatic piston-cylinder mechanism forming part of the nail gun, in a conventional manner.

Such a nail gun is normally constructed so that no nail can be fired therefrom until two mutually independent release devices have been set to a given, suitable adjustable firing mode. These devices may have the form of a finger-operated compressed-air valve, which must be held in an open position in order for the gun to fire, and a so-called safety-catch mechanism which in its safe mode projects beyond the muzzle orifice of the gun barrel and which, in order to fire the gun, must be pressed-in or retracted to an extent which enables the muzzle of the barrel to lie against the workpiece to be nailed, or to an extent such that the safety device occupies a pre-determined firing position. Thus, the nail located in the barrel bore cannot be separated from the nail strip and, in conjunction therewith, driven into the workpiece with the aid of the pneumatic plunger or percussion rod until the aforesaid pre-determined firing modes are adopted.

The feed means for advancing the nail strip to the nail driving location in the barrel of the gun may have many forms. For example, the feed means may have the form of tensionable spring mechanisms, or may well comprise a pneumatically driven mechanism provided with a piston which is held under tension against the trailing edge of the nail strip loaded in the magazine. The points at which the magazine is attached to the nail gun and its associated nail driving section are suitably positioned so that the strip guide path can be readily detached from the nail driving section, for example by enabling the magazine to be swung or pivoted away from the nail driving section, subsequent to releasing a holding catch. This is found beneficial inter alia, when wishing to remove a faulty or damaged nail, or when wishing to clean the magazine and replace worn components therein.

The basic concept of the invention lies in utilizing the retraction of the safety device, which is movable in relation to the nail driving section, necessary in order for a nail to be driven by the gun, to move the latching surface into contact with the latching means, which is then moved by the latching surface into contact with the nail positioning element, which in turn is moved thereby into position-fixing latching engagement with the strip at a location immediately behind the nail located in the nail driving location. In practice, it may be suitable for the nail positioning element to engage the nail lying immediately behind the foremost nail in the strip, as seen in the nail driving direction, i.e. the next foremost nail. This provides the important advantage of enabling the nail strip to be utilized to a maximum, in which it finally comprises solely two nails, of which the foremost nail is located in the nail driving location, while the other, rearwardly located nail serves to accurately position the foremost nail through latching engagement with the nail positioning element. Subsequent to the foremost of the two remaining nails being separated from its neighbour and driven into the workpiece, there remains but a single nail which, due to the particular construction of the nail driving location, is prevented from twisting in said location and can be suitably retained in the axial direction in the nail driving location in the barrel with the aid of separate means herefor, for example a permanent magnet arranged in the wall of the bore. This last remaining nail can then be driven into the workpiece subsequent to placing a fresh nail strip in the magazine. If, for some reason or other, it is desired to avoid firing single nails, there can readily be provided a catch means which, when only a few nails remain, prevents the safety device from being retracted or withdrawn and therewith prevent further firing of the gun. Nail driving can then be re-continued as soon as a fresh nail strip has been placed in the magazine behind the residual nail strip.

This catch means can also have the function of preventing the gun from being fired when no (remaining) nail is found in the magazine or in the nail driving location in the bore of the barrel. It is desirable from the aspect of wear and tear on the nail gun to provide means which prevent the gun from being fired when unloaded, i.e. so that the gun cannot be fired when no nails are present in the magazine.

Further developments of the arrangement according to claim 1 are disclosed in dependent claims 2–6.

Claim 2 defines one advantageous embodiment of the nail driving section and also discloses the manner of assembling said section to the nail gun, together with a suitable safety-catch mechanism and the construction of the nail positioning element and its arrangement in the nail driving section.

Claim 3 defines a safety-catch mechanism suitable for effecting simple and effective co-action between the aforesaid latching surface, the latching means and the nail positioning element.

Claim 4 defines the manner in which the nail driving section, in the form of a housing part, can be constructed in order to accommodate the nail positioning element with associated journal shaft, and the latching means together with associated holder part, in a ready and convenient fashion. According to the claim, these components are arranged in a recess in the housing part, which is particularly formed to this end.

Claim 5 defines an advantageous embodiment of the biassing means and the manner in which it is mounted between the safety device and the housing section.

Claim 6 defines an advantageous embodiment of the feed means by means of which the nail strip is advanced in the magazine, the feed means in this case maintaining a continuous forward bias on the strip in a direction towards the nail driving location.

Claim 7 defines the manner in which the nail driving location can be constructed in order to prevent twisting of the last nail of a nail strip.

The invention will now be described in more detail with reference to an exemplifying embodiment of an arrangement according to the invention illustrated in the accompanying drawings, in which FIG. 1 is a side view in vertical projection of an arrangement according to the invention mounted in the forward part of a nail gun intended for driving nails in a vertical direction;

FIG. 2 is a horizontal cross-sectional view through the arrangement, taken on the line II—II in FIG. 1;

FIG. 3 is a sectional view of the nail driving section taken on the line III—III in FIG. 2; and FIG. 4 is a partial sectional view of the forward part of the nail driving section, taken on the line IV—IV in FIG. 1.

Reference is first made to the side view of FIG. 1, which illustrates the lower (forward) part of a nail driving apparatus 1, of which only a part is included in the illustration. In the illustrated figures the barrel 2 of the apparatus is shown in a vertical working position, while FIG. 3 illustrates the bore 3 of the barrel, and shows the geometric longitudinal center axis 4 thereof.

The arrangement according to the invention includes a nail driving section, generally shown at 5, which forms part of the apparatus 1 and comprises a housing part which accommodates the nail driving barrel 2. Connected to one side of the housing part 5 is a nail strip magazine, in which the nail strips loaded therein are placed under bias in the feed direction. The magazine 6 incorporates a strip guide path 7, one end of which enters the housing part 5, as illustrated in FIGS. 1–2. The strip guide path 7 is held in its desired inserted position with the aid of a holder device 8, having a lower end 9 which engages around the bottom edge of the guide path 7. The holder device 8 has an upper attachment part 10, which is firmly connected to the casing of the nail driving apparatus 1, or to an element securely connected to the case. The magazine 6 is held inserted in the housing 5 by means of a latch spring 11 attached at one end to the strip guide path 7, the free end 12 of the spring 11 abutting a bevelled surface 13 on the holder device 8, thereby preventing withdrawal of the magazine from the housing part 5. The combination of the inherent biassing force of the latch spring 11 and the bevelled surface 13 ensures that the magazine 6 is held effectively in its inserted position, even after being used for a long period of time, with repeated removal and re-fitting of the magazine 6 resulting in wear on the free end 12 of the latch spring 11 and on the bevelled surface 13.

The magazine 6 has provided therein a longitudinally extending channel 14 in which the nail strip (not shown) is accommodated and biassed towards a nail driving location in the bore 3 in the housing 5.

This bias on the nail strip can be achieved with the aid of a coiler or like winding-up mechanism 15 which is mounted adjacent the strip guide path 7 and from which a traction belt 16 can be withdrawn against the action of a coiling force. The free end 17 of the belt 16 has attached thereto a thrust pad 18 which is guided for sliding movement along the strip guide path 7. The thrust pad is intended to be placed against the distal or trailing edge of the nail strip loaded in the channel 14 of the guide path, so as to exert a pushing force on the nail strip. The thrust pad 18 has provided thereon a thumb or finger grip 19, which projects outwardly from the guide path 7 and which is used to withdraw the thrust pad and place the same behind the trailing edge of a nail strip. The thrust pad 18 is provided on its right-hand rearward end, as seen in the drawing, with a hook 20 by means of which the pad can be readily hooked onto the free outer edge 21 of the magazine 6. Since the thrust pad 18 is constantly subjected to a traction force from the belt 16, the insertion of a fresh nail strip into the channel 14 can be readily facilitated by hooking-up the thrust pad in its fully extended or withdrawn position. As soon as this fresh nail strip has been loaded into the channel 14, the hook 20 is pressed down in the channel, so that the traction belt 16 is able to draw the thrust pad into abutment with the trailing or rearward edge of the nail strip. The nail strip is therewith placed under forward bias.

The nail driving section or housing part 5 of the arrangement will now be described in more detail. The housing part 5, into which the left-end of the magazine 6 is inserted, is attached to a base plate 22, which is screwed or bolted firmly to the apparatus casing, e.g. with the aid of bolts 23.

As beforementioned, the apparatus is provided in a conventional manner with a safety-catch mechanism, such as the illustrated stirrup-like structure 24, which is provided at its lower end with a cocking sleeve 25, which is mounted for axial movement along the barrel 2 and which at least partly surrounds the muzzle end thereof, and which constitutes a forwardly located safety-device guide means. The stirrup-shaped safety device 24, mounted for axial movement on the housing part 5, has a side-leg part 26 to which there is connected a rearwardly extending leg 27. This leg 27 is connected with and operates a safety rod 28, which must be pressed inwardly (upwardly in FIG. 1) before a nail can be fired from the apparatus 1 and driven into the workpiece.

The side-leg part 26 is also guided along the housing part 5, through the agency of an edge part of the side-leg part 26 which projects into a channelled bar 29, or like device, attached to the side of the housing part 5, as clearly shown in FIG. 2.

The rear part 30 of the side-leg part 26 remote from the cocking sleeve 25 has provided therein a guide curve 31, the purpose of which will be explained hereinafter.

The safety device 24, which is movable in relation to the nail driving section or housing part 5, is held in its forward, safety position (illustrated in FIGS. 1 and 3) with the aid of a thrust spring, which in this embodiment has the form of a coil spring, inserted between an internal, rearwardly facing surface 32 on the side-leg part 26 and an opposing, outwardly facing surface 33 on the housing part 5. The coil spring is referenced 34 in FIG. 3.

The nail positioning mechanism effective in firmly holding the nail strip and constituting the central concept of the invention will now be described in more detail with particular reference to FIGS. 2 and 3. The purpose of this nail positioning mechanism is to ensure that the foremost nail of a nail strip, i.e. the nail in line to be separated from the strip and fired from the apparatus, is positioned exactly as desired. Thus, this nail must be positioned accurately in the intended nail driving location in the bore 3 of the barrel 2 during the actual nail stripping and firing sequences. The nail positioning mechanism includes a rotatable and cylindrical nail positioning element 35 having splines or like protruberances 36 extending axially therealong and arranged to be brought into engagement with the nail strip. In the illustrated embodiment the cylindrical element 35 is mounted on a journal pin 37 which extends parallel with the barrel 2 and which is journalled for rotational and sideways movement in the housing part 5. The nail positioning mechanism also includes the aforedescribed safety-catch mechanism 24, and in particular the rearward part 30 thereof provided with the guide curve 31. The arrangement also incorporates a latching means 38, in this embodiment having the form of a spherical body, which is arranged for movement between the guide curve 31 and the nail positioning element 35, said guide curve 31 being movable upwardly together with the safety device 24 and forming a latching surface in the region of the nail positioning element 35. Thus, when the safety device 24 is pushed upwardly in FIGS. 1 and 2 (i.e. moved to its non-safety mode so that the apparatus can be fired) the spherical body is acted upon by the latching surface 31 and causes the element 35 to move into position-fixing latching engagement with the nail strip at a location immediately behind the foremost nail present in the nail driving location. Alternatively, the nail positioning element 35 may be arranged to be brought into engagement with the next foremost nail in the nail strip, this alternative being preferred in practice.

The nail positioning element 35, in this embodiment shown to be a spur pinion, its associated journal shaft 37, together with the latching means 38 and a holder part 39 by means of which the latching means is held axially in the housing part 5, are all accommodated in a recess 40 provided in the housing part (see in particular FIG. 2). This recess lies opposite the latching surface or guide curve 31 and extends into the housing part substantially at right angles to the strip guide path 7 detachably inserted therein. The innermost part of the recess 40 connects with a cut-out 41 located in the barrel 2 and adjoining the nail driving location in the bore 3, this cut-out 41 forming an extension of the strip accommodating channel 14 of the strip guide path 7.

When the safety device 24 is retracted (upwards in FIGS. 1 and 3) in order to enable a nail to be fired through the barrel 2, the guide curve 31, which is non-parallel with the center axis 4 of the barrel, is moved towards and into contact with the spherical latching means 38, which is therewith urged radially inwards in the housing part and brought between two mutually adjacent splines 36 on the positioning element 35. The nail positioning element is therewith locked against rotation and is displaced by the spherical body 38 to positioning latching engagement with the nail strip in the region of the next foremost nail therein. This latching engagement of the splined element 35 with the nail strip thus provides the desired fine adjustment of the strip, by slightly advancing or slightly withdrawing the next foremost nail, as the case may be, so as to position the next foremost nail precisely as desired, and therewith also the foremost nail present in the nail driving location.

The various components of the nail positioning mechanism are so dimensioned and adapted with respect to one another as to achieve the aforesaid latching retention of the next foremost nail in the nail strip through the agency of the positioning element 35 when the safety device 24 is pressed-in or retracted to an extent such that the slideable cocking sleeve 25 has been moved along the barrel 2 through a distance such that the free, front surface 42 of the barrel is in contact with the surface of the workpiece to be nailed or has reached a pre-determined firing position in relation to the surface of the workpiece against which the cocking sleeve is pressed. The rod 28 manipulated by the rearwardly directed leg 27 of the safety device 24 is therewith moved to a position in which the precisely positioned, foremost nail in the nail driving location can be fired from the apparatus and driven into said workpiece. The actual process of separating the thus correctly positioned nail from the remainder of the nail strip is effected in a known manner, with the rapid percussion-like movement of the reciprocatingly movable plunger or percussion rod 43 downwardly in the bore 3 of the vertically positioned barrel 2, the plunger or percussion rod 43 preferably being pneumatically operated. The nail positioned in the nail driving location is therewith first sheared from the remainder of the nail strip and then driven by the aforesaid rapid percussion movement through the bore 3 of the barrel and into the workpiece surface against which, or in the proximity of which, the front muzzle surface 42 of the barrel 2 is placed. Upon completion of a nail driving stroke, the percussion rod or plunger 43 returns to its starting position, illustrated in FIG. 3. As the percussion rod or plunger returns to its starting position, the nail driving location in the bore 3 of barrel 2 is automatically exposed, therewith enabling the nail strip to be advanced through one nail pitch by the strip feed mechanism, which in this embodiment consists of the traction belt 16 of the coiler mechanism 15 and the thrust pad 18 attached to the belt.

When the nail next in line is positioned in the nail driving location in the barrel 3, the nail driving apparatus, or nail gun, is cocked for firing, by pressing-in the safety device 24 and therewith finely positioning the nail precisely in the nail driving location. As will be understood, in automatic nail driving operations, the cycle of events embracing nail-driving, percussion-rod retraction, nail-feed, retraction of the safety device, fine positioning of the foremost nail in the nail strip, nail-driving, etc., can be repeated continuously at very short time intervals.

Finally, attention is drawn to a number of practical structural details of the arrangement according to the invention, with reference to the illustrated embodiment. The housing part may be provided with means for preventing the last, lone nail in the bore 3 (so-called single nail) from falling from the bore of a downwardly facing barrel. An example of such means is illustrated in FIG. 3 in the form of a permanent magnet 44, which extends radially into the wall of the barrel 2 and the radially inner end surface of which forms part of the wall-surface defining the bore 3. The magnet 44 is mounted in a non-magnetic bushing or sleeve 45 placed in a radial bore in the housing part 5, and in the event of a single, unattached nail being located in the nail driving location is operative in retaining the nail in said location.

As will be understood, as the plunger or percussion rod 43 executes a forward working stroke in the bore 3, therewith stripping a nail from the nail strip and driving said nail into the workpiece, the remaining nails in the adjoining part of the nail strip, opposite the cut-out 41 in the barrel 2 (FIG. 2) will be subjected to a corresponding shear force, which must be taken-up by a counter reaction force at the downwardly facing long edge of the nail strip as seen in the figure. Consequently, a robust anvil device is preferably arranged to extend along this long edge of a nail strip in the vicinity of the nails located foremost in the strip. As illustrated in FIG. 1, this anvil device may suitably have the form of a bevelled, hard-steel angle element 46 capable of acting as a reaction surface or back-up surface for the remaining nails in the strip and extending fully into a peripheral recess 47 in the cocking sleeve 25 (see FIG. 4).

It may also be desirable at times to make the apparatus safe against further firing of nails when only a few nails remain in the nail strip. To this end, the leg 27 of the safety device 24 may have provided therein a slot 48 for receiving the limb 49 of the thumb grip 19 when all but a few nails have been separated from the nail strip, thereby rendering it impossible to press-back the safety device 24 and recock the apparatus.

It should be mentioned here that the majority of banded, integrated nails used in apparatus or devices of the kind described in the aforegoing and illustrated in the accompanying drawings, have a non-circular head or nail part, for example a D-shaped head. In order to prevent a nail from twisting or turning in the bore of the barrel, the upper part of the barrel bore (as seen in the figure) may be given a non-circular cross-sectional shape similar to that of the non-circular head or stem part of the nails. This non-circular configuration of the bore cross-section need only be found in the region of the bore in which the nail head is located prior to firing the nail from the apparatus.

It will be understood that the invention is not restricted to or determined by the described and illustrated embodiment thereof, and that modifications can be made within the scope of the following claims.

I claim:

1. An arrangement in nail driving apparatus (1), such as a nail gun, comprising a nail driving section (5), a nail strip magazine (6) adjoining said section and accommodating a strip of banded or mutually integrated nails; means for stripping nails singly from said nail strip and driving said nails separately into the surface of a workpiece to be nailed; safety-catch means for placing the apparatus in a non-firing mode; and means for advancing said nail strip into the nail driving section (5) and for holding said nail strip in said section, characterized in that the magazine (6) incorporates a nail strip accommodating strip guide path (7) which connects with said nail driving section (5); in that the strip guide path (7) has slideably arranged therein feed means (17, 18) for advancing the nail strip along the guide path, towards a nail driving location in the nail driving section (5); in that the nail driving section (5) has journalled for rotational and sideways movement therein a nail positioning element (35) which can be brought into engagement with the nail strip and which is operative in accurately positioning in said nail driving section the foremost nail in the strip which is next in line to be separated from the strip and driven into said workpiece; in that the safety-catch means (24) is movable relative to the nail driving section and is held in a forward safe position by means of a tension means (34); in that the safety catch has provided thereon in the vicinity of the nail positioning element a latching surface (31); in that a latching means (37), e.g. a spherical element, is mounted for movement between the latching surface and the nail positioning element, the arrangement being such that when the safety-catch means (24) is retracted to a firing mode the latching means (38) is actuated by the latching surface (31) and moves the positioning element (35) into position-fixing latching engagement with the nail strip in the region thereon immediately behind the foremost nail located in the nail driving section; and in that the nail driving location is so constructed as to prevent a separate nail (lone nail) from twisting therein.

2. An arrangement according to claim 1, characterized in that the nail driving section forms an apparatus housing part (5) which accommodates the nail firing barrel (2) of the apparatus and which is attached to an attachment plate (22) in the apparatus, and on which housing part the safety-catch means (24) is mounted for movement in the axial direction of the barrel (2) and is guided thereby; and in that the nail positioning element (25) has the form of a splined or toothed cylindrical body mounted on a journal shaft (37) which extends at least substantially parallel with the barrel and which is mounted for rotational and sideways movement in the housing part (5).

3. An arrangement according to claim 2, characterized in that the safety-catch means (24) is of stirrup-shaped configuration and comprises a side-leg part (26) connected to a cocking sleeve (25) which is mounted for axial movement along the barrel (2) of the apparatus (1) and the free forward end of which is intended to be pressed against the workpiece to be nailed so as to retract the safety-catch means; and in that the side-leg part (26) has provided on a rearward part (30) thereof remote from the cocking sleeve (25) a guide curve (31) which faces towards the latching means (38) and which extends at least partially non-parallel with the geometric longitudinal center axis (4) of the barrel (2), and which when the safety-catch device is retracted is moved against the latching means (38), therewith to move said latching means radially inwards in the housing part (5) into engagement between two mutually adjacent teeth or like protuberances (36) on the cylindrical body, therewith to lock the cylindrical body against rotation and to bring said cylindrical body into latching engagement with the nail strip in the vicinity of the next foremost nail in said strip.

4. An arrangement according to claim 2, characterized in that the toothed or splined cylindrical positioning element (35), the journalling shaft (37), the latching means (38), and a holder part (39) for holding the latching means axially in the housing part, are accommodated in a recess (40) formed in the housing part, said recess in the region of the guide curve (31) on the side-leg part extending into the housing part (5) substantially at right angles to the strip guide path (7) detachably inserted thereinto; and in that the innermost end of the recess connects with a cut-out (41) in the apparatus barrel (2) adjacent the nail driving location, said recess forming an extension of the strip accommodating channel (14) in the strip guide path (7).

5. An arrangement according to claim 1, characterized in that the tensioning means has the form of a coil spring (34) located between on the one hand an internal rearwardly facing surface (32) on the side-leg part (26) in the region of the forward part thereof, and on the other hand an opposing, outwardly facing surface (33) on the housing part (5).

6. An arrangement according to claim 1, characterized in that the feed means is a nail strip biassing device which comprises a coiler mechanism (15) mounted adjacent the strip guide path (7), and a traction belt (16) which can be withdrawn from the coiler mechanism against the action of a coiling force exerted thereby, and a thrust pad (18) slideably mounted in the strip guide path (7) and connected to the free end of the traction strap, said thrust pad being intended to be placed against the trailing end of the nail strip in the channel (14) of the strip guide path so as to exert a pushing force on the nail strip.

7. An arrangement according to claim 1, when the nails have a non-circular part, characterized in that part of the bore (3) of the barrel (2) exhibits a non-circular cross-sectional shape corresponding to the non-circular shape of said nail part, such as to prevent twisting or turning of a nail in the nail driving location.

* * * * *

UNITED STATES PATENT AND TRADEMARK OFFICE

CERTIFICATE OF CORRECTION

PATENT NO. : 4,768,696

DATED : September 6, 1988

INVENTOR(S) : Borje SJOGREN

It is certified that error appears in the above—identified patent and that said Letters Patent is hereby corrected as shown below:

In the caption of the patent, please amend Item 22 to read as follows:

[22] PCT Filed: March 25, 1987

Signed and Sealed this

Tenth Day of January, 1989

*Attest:*

DONALD J. QUIGG

*Attesting Officer*

*Commissioner of Patents and Trademarks*